United States Patent [19]

Luck

[11] 3,959,900

[45] June 1, 1976

[54] IMPLEMENT ASSEMBLY FOR HYDRAULICALLY OPERATED EXCAVATORS

[76] Inventor: Dieter G. Luck, 147 Jacaranda Road, Kyalami, Extension 1, Transvaal, South Africa

[22] Filed: Apr. 2, 1975

[21] Appl. No.: 564,293

[30] Foreign Application Priority Data

Apr. 3, 1974 South Africa ..... 74/2115

[52] U.S. Cl. ..... 37/117.5; 37/DIG. 3; 299/37

[51] Int. Cl.[2] ..... E02F 3/46

[58] Field of Search ..... 37/117.5, DIG. 3; 299/37, 67; 178/777, 778

[56] References Cited

UNITED STATES PATENTS

| | | | |
|---|---|---|---|
| 2,840,931 | 7/1958 | Appel | 37/117.5 |
| 3,061,123 | 10/1962 | Rogers | 37/DIG. 3 |
| 3,702,712 | 11/1972 | Cairns | 37/117.5 X |
| 3,778,111 | 12/1973 | Ciofani | 37/117.5 |

*Primary Examiner*—Stephen C. Pellegrino
*Attorney, Agent, or Firm*—Mason, Fenwick & Lawrence

[57] ABSTRACT

This invention concerns an implement for a hydraulic excavator comprising essentially a ripper and a scoop wherein these implements may independently fulfill their respective operations while both are mounted on the dipper arm. The scoop may be swung rearwardly behind the ripper when the latter is in use and will form part of the face of the scoop when the scoop is in use. Relative movement between the scoop and ripper is effected essentially by an auxilliary hydraulic piston and cylinder assembly on the excavator.

2 Claims, 7 Drawing Figures

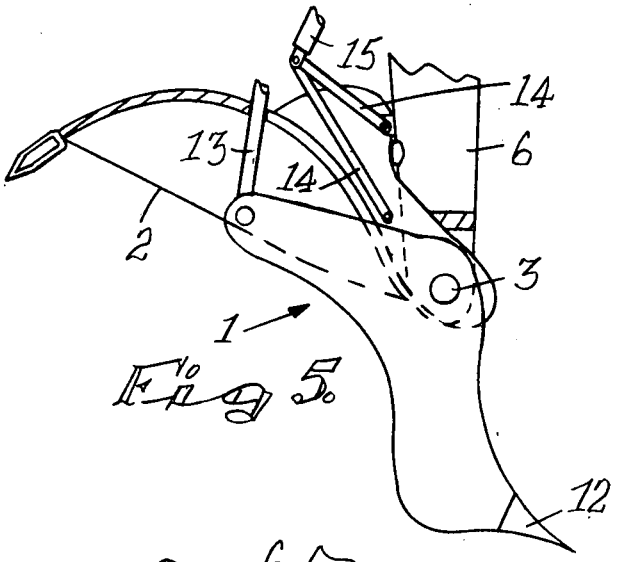
Fig 5.
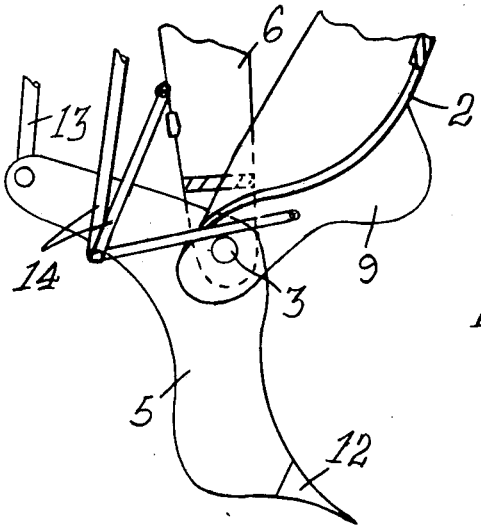
Fig 6.
Fig 7.
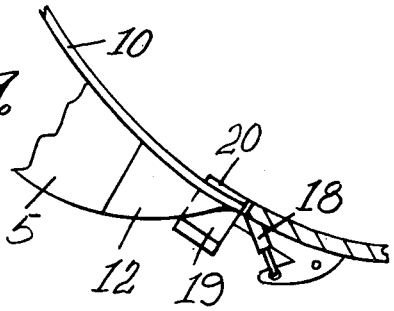

IMPLEMENT ASSEMBLY FOR HYDRAULICALLY OPERATED EXCAVATORS

This invention relates to excavators and more particularly to excavators that are hydraulically operated and utilise both rippers and buckets in their operation.

BACKGROUND TO INVENTION

Excavators of the above type operate on the "back hoe" principle and it is usual for the same machine to both rip and shovel earth in scoop or hole making operations. Usually separate implements may be attached to the dipper arm of the machine to independently effect the different operations. Recently however it has been successfully proposed that the ripper be maintained operatively positioned on the machine and used to support a detachable scoop when the latter is required to be used. The detachable mounting of the scoop on the ripper while being an appreciable improvement on the interchangeable implement arrangement nevertheless requires a second workman to assist in the mounting or release of the scoop and also skill is required to locate the ripper and scooper in the proper relationship to enable mounting of the scoop to be effected.

SUMMARY OF THE INVENTION

The object of the present invention is to provide an excavator which will enable a ripper or bucket operation to be effected without any assistance to the excavator operator being required.

According to this invention there is provided an implement assembly for an hydraulically operated excavator comprising a ripper having a bucket pivotally supported thereon and means for moving the bucket between operating and non-operating positions and in which the bucket in the operating position is supported on the ripper.

Further features of this invention provide for the bucket to be slotted partway around its central periphery to enable the outer end of the ripper and its control piston rod to pass therethrough during pivotal movement of the bucket, for the pivotal movement to be effected through a linkage system and an hydraulic piston and cylinder assembly, for the bucket to swing into an inoperative position behind the ripper working face and for the latter to form part of the bucket inner surface when the bucket is in the operative position.

The invention further provides for the bucket to have means enabling it to move longitudinally relative to the ripper to retain it in an operative position.

A preferred embodiment of this invention is described below with reference to the accompanying drawings.

BRIEF DESCRIPTION OF THE DRAWINGS

FIG. 5 is a similar view to FIG. 4 but with the ripper in a different operative position;

FIG. 6 shows a form of this invention wherein the bucket is swung forwardly into an inoperative position; and FIG. 7 is a detail of an alternative locking arrangement.

DESCRIPTION OF PREFERRED EMBODIMENT

Figure 1:
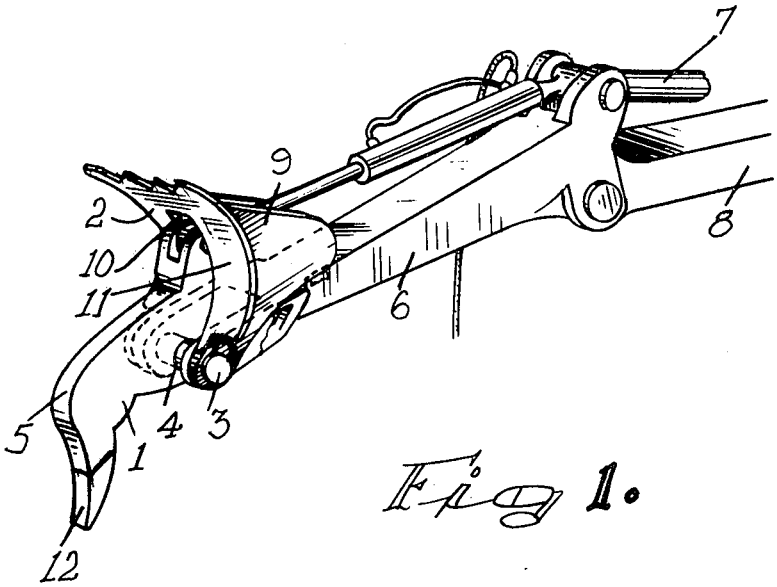
FIG. 1 is a diagrammatic perspective view of the bucket in a semi-retracted position behind the ripper, (in this view the linkage and auxilliary piston and cylinder have been omitted and the bucket shown as a bent plate for simplicity only)
Figure 2:
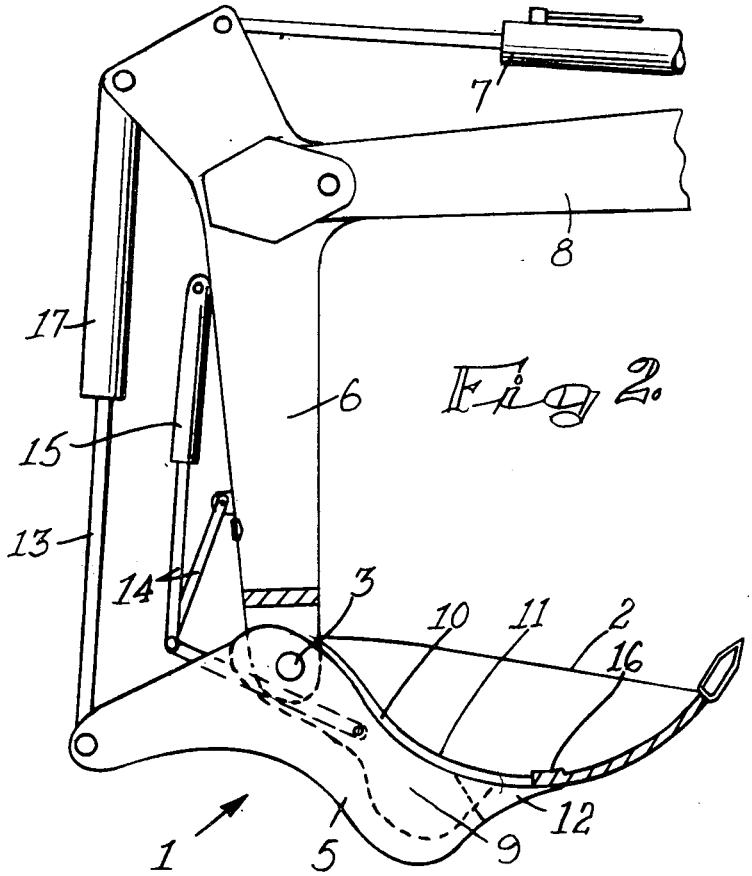
FIG. 2 is a part sectional elevation of the assembly with the bucket in one operative position.
Figure 3:
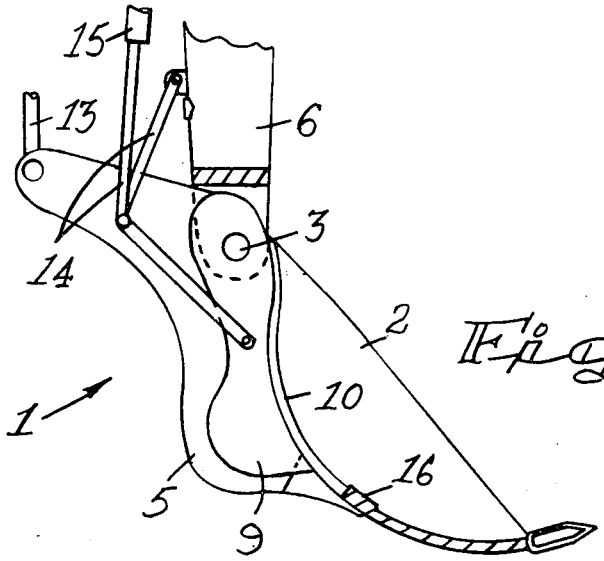
FIG. 3 is a part sectional elevation of the assembly with the bucket in another operative position.

In the construction illustrated in FIGS. 1 to 3 a normal type of hydraulically operated excavator has a modified ripper assembly 1 enabling a bucket 2 to be pivotally mounted thereon. The pivot 3 for the bucket is preferably the ripper bush 4 which extends outwardly on either side of the ripper shank 5 and is inherently of strong and rigid construction for the normal operation of the ripper.

The ripper is mounted in the forked end of the dipper arm 6 in the conventional manner and the dipper arm 6 is operated through the usual main piston and cylinder assembly 7 mounted on the boom 8. The ripper assembly 1 can have a variable operative position relative to the dipper arm 6 and the angle of variation is usually about 65°. FIGS. 2 and 3 show the ripper assembly 1 in angles of inclination to the dipper arm 6 near the extremities of its movement.

The bucket 2 has specially formed flanges 9 projecting from the rear face thereof to provide the pivot bearing which is elongated in the embodiment shown in FIGS. 2 and 3 to enable the bucket 2 to have a limited movement along the length of the ripper shank 5.

The bucket 2 has a slot 10 formed around part of the central periphery 11 thereof in a manner enabling pivotal movement of the bucket 2 relative to the ripper to cause the ripper assembly 1 including the digging tine 12 and operating piston rod 13 to pass through the bucket wall.

A linkage 14 between the end part of the dipper arm 6 and the flange 9 is connected also to an auxilliary bucket moving hydraulic piston and cylinder assembly 15. This piston and cylinder assembly is adapted to have fluid pressure acting on either side of the piston in a manner which enables the linkage 14 and piston and cylinder assembly 15 to operate either to maintain the bucket 2 in operative engagement with the ripper shank 5 even while the latter is moved relative to the dipper arm 6 during use. This is effected by having the pump (not shown) connected to cylinder 15 continually deliver fluid under pressure to the piston and cylinder assembly in a manner which tends to hold the assembly 15 with the piston in its retracted position.

When the bucket 2 is caused to move with the ripper 1 relative to the dipper arm 6 in working movement this tendency is against that of the break out force exerted by the ripper 1 operating piston and cylinder assembly 17 but is of such a low order of magnitude as to be practically ineffective on the break out force.

When flow in the piston and cylinder assembly 15 is directed to the opposite side of the piston the latter is caused to extend from the cylinder. This movement enhanced by the weight of the bucket 2 caused the bucket 2 to move relative to the pivot 3 and ripper 1 to release the latter from engagement retaining the bucket thereagainst. It is preferred to have the arrangement holding the bucket in position even though the working forces exerted on the bucket 2 will in any event tend to hold the bucket 2 in position.

Referring to FIG. 2 it will be seen that the bucket 2 is supported against the ripper shank 5 by engagement of the digging tine 12 with a lug 16 formed on the bucket 2 adjacent the end of the slot 10 remote from the pivot mounting. The rear face of the wall of the bucket 2 may be further supported by a special section of the ripper shank 5 if this is desirable.

In this position the pivot mounting bearing is in engagement with the pivot 3 at its end nearest to the digging edge and all normal operating forces will lend to retain it in this position. This is so even when the operative position of the ripper assembly 1 is varied relative to the dipper arm 6 during the usual type of bucket scooping operations conducted with an excavator of the type to which this invention is directed.

Figure 4:
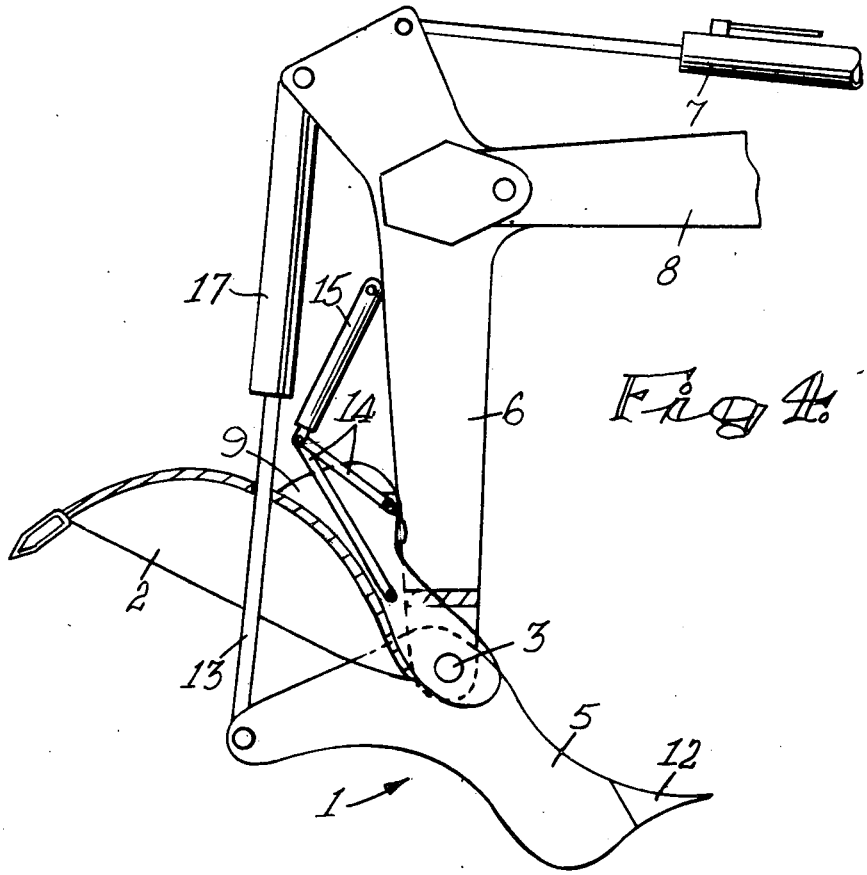
FIG. 4 is a similar view but with the bucket in a fully retracted position.

To reach this position from that shown in FIG. 3 the ripper 1 and bucket 2 are brought into a position away from that which they occupy at the end of the working stroke and the linkage 14 piston and cylinder 15 operated to cause the bucket 2 to move the bucket bearing on bush 4 into engagement with the end remote from the digging edge. At this point the piston movement is discontinued either by control of fluid flow to the assembly or by restraining further movement of the bucket. Movement of the ripper piston and cylinder assembly 17 will then cause the ripper assembly 1 to move through the slot in the bucket 2. To bring the latter into the position shown in FIGS. 4 and 5 the linkage piston and cylinder movement is reversed and the piston fully retracted and held by continuous operation of the pump. To bring the bucket into operative engagement the sequence of movements is reversed. The linkage and auxilliary piston and cylinder assembly 15 can be used with assembly 17 to swing the bucket without engaging the latter in the ground if desired.

From the above it will be seen that the bucket 2 and ripper 1 can be used by the excavator operator at will and no additional labour or skill is required to bring either implement into use. The bucket is permanently attached to the machine and there is no possibility of its being lost or left at the site of a previous use. Both time and labour are consequently saved by the use of equipment according to this invention.

With the bucket in the inoperative position behind the dipper arm 6 it is found not to interfere with the usual ripper operations.

Many modifications can be made to the example described above and one such modification is shown in FIG. 6. In this construction the bucket 2 is swung from the operative position where it is supported by the ripper assembly 1 in an inoperative position shown in front of the ripper shank. With such a construction it may be possible to avoid the necessity of making a slot 7 through the wall of the bucket 2. However, the presence of the bucket in this inoperative position will generally interfere with the operation of the ripper for example when holes are being excavated. The positions of the parts shown in FIG. 6 show the best relationship between ripper and bucket and it will be appreciated that this position is that where the bucket 2 can give the least interference with ripper operations. For this reason it is considered that the rearwardly movable bucket assembly is to be preferred.

The relationship between the ripper assembly 1 and the slot 10 can be made such that the loading of dirt will not interfere with the operation of the relatively moving parts and such movement can be made to effect self-cleaning of the parts.

It will be appreciated that the use of the additional piston and cylinder assembly to control movement of the bucket relative to the ripper will require very little energy to have a negligible effect on the overall working efficiency.

Other modifications include variations in the form support for the bucket in the operative position. For example an hydraulically or mechanically operated lock operating on a calliper principle can be used to cause locking pins to release or engage in shaped slots in the flanges 6 and through apertures in the ripper shank 5. Suitable bearing surfaces will be imparted to the assembly. These pins and slots will be made to ensure that the relative movement between the normal terminal positions of the ripper relative to the ripper arm 1 can be maintained.

FIG. 7 illustrates another form of locking device and this comprises a small piston and cylinder assembly 18 used to pivot a bracket 19 movable in the slot 7 so that it can be brought into or out of engagement with the tine 10 on the ripper shank. When it is engaged as illustrated the bucket is held operatively engaged but the bracket is pivotted forwardly, the tine 10 will clear the edge 20 of the bracket 19 and enable the bucket to be stowed behind the ripper.

The embodiment which use locking arrangements different from that described with reference to FIGS. 2 to 5 may not require the slotted bearing arrangement as no relative longitudinal movement between bucket and ripper will be necessary.

The descriptions given above are of a general nature and it will be appreciated that modifications will have to be made to existing equipment of various types to enable the invention as described above to be applied thereto. This is within the ability of one skilled in the art and does not require any inventive ingenuity.

What I claim as new and desire to secure by Letters Patent is:

1. An implement assembly for a hydraulically operated excavator including an excavator dipper arm, said assembly comprising:

a. ripper pivotally connected to the dipper arm, b. a hydraulic operating piston and cylinder operatively connected between the dipper arm and the ripper, c. a bucket pivotally supported on the ripper, d. means for allowing a constrained relative longitudinal movement between the ripper and bucket, e. said bucket having a slot through the bucket extending from the pivot towards a free end of bucker permitting passage of the ripper and its operating piston rod therethrough, f. a hydraulic piston and cylinder means operatively connected between the excavator dipper arm and the bucket for moving the bucket between an inoperative position behind the ripper and an operating position wherein it aligns the ripper with the bucket to close the slot through the bucket.

2. An implement assembly as claimed in claim 1 wherein the constraining means includes having the bucket and the ripper pivot about the same axis on the excavator dipper arm.

* * * * *